US006223668B1

(12) United States Patent
Chan

(10) Patent No.: US 6,223,668 B1
(45) Date of Patent: May 1, 2001

(54) METHOD AND APPARATUS FOR HAND STITCHING OF SPORTS BALLS

(75) Inventor: Chong Veng Chan, Shatin (HK)

(73) Assignee: Joyful Long Industries, Ltd, Kowloon (HK)

( * ) Notice: Subject to any disclaimer, the term of this patent is extended or adjusted under 35 U.S.C. 154(b) by 0 days.

(21) Appl. No.: 09/442,711

(22) Filed: Nov. 18, 1999

(51) Int. Cl.[7] ..... D05B 35/04

(52) U.S. Cl. ..... 112/475.08; 112/470.14; 112/470.35

(58) Field of Search ..... 112/475.08, 470.35, 112/470.14, 2, 19, 475.17; 473/605, 604

(56) References Cited

U.S. PATENT DOCUMENTS

| | | | | |
|---|---|---|---|---|
| 3,151,584 | * | 10/1964 | Fossa | 112/470.35 |
| 4,248,165 | * | 2/1981 | Addy | 112/470.35 |
| 4,403,557 | * | 9/1983 | Dietrich | 112/470.14 |
| 5,772,545 | * | 6/1998 | Ou | 473/605 |

* cited by examiner

*Primary Examiner*—Peter Nerbun
(74) *Attorney, Agent, or Firm*—Fish & Richardson P.C.

(57) ABSTRACT

A method is provided for hand stitching a multi-panel sports ball. The method includes moving the free ends of opposed gripping arms of a panel gripping assembly into an open position; positioning a pair of panels to be stitched to form a multi-panel sports ball between the free ends, with edges of the panels and holes formed along the edges being in position for stitching; allowing the free ends to move from the open position to a closed position; forming a first stitch in the panels by passing a stitching fiber through a first set of aligned holes in the panels; engaging opposite ends of the stitching fiber in first and second gripping members disposed at opposite sides of said gripping arms; tightening the first stitch by actuating a pneumatic cylinder associated with the first and second gripping members to move the first and second gripping members relatively apart; removing the opposite ends of the stitching fiber from the first and second gripping members; and, repeating the stitch-forming and stitch-tightening steps to form subsequent stitches, until stitching along the edge is completed.

12 Claims, 9 Drawing Sheets

METHOD AND APPARATUS FOR HAND STITCHING OF SPORTS BALLS

The invention relates to manufacture of sports balls, in particular, inflatable sports balls, formed of stitched panels.

BACKGROUND OF THE INVENTION

Inflatable sports balls, such as for soccer and volleyball, are formed of multiple panels stitched together at seams formed along adjacent panel edges to form a cover, within which an inflatable bladder is placed prior to closure. The panels of these sports balls are typically stitched together by hand, although a pending application by the present inventor, as well as U.S. Pat. No. 5,759,123 and U.S. Pat. No. 5,772,545, describe air-inflatable sports balls with at least some of the panels joined by machine stitching.

The traditional hand stitch process is often facilitated by a device that consists of a triangular frame, formed, e.g., of bamboo or other suitable material, and open at the apex. A pair of panels to be stitched together is placed in the opening with the edges to be stitched and the stitch holes in alignment (typically the stitch holes are formed through both panels in a single punching or piercing operation). The worker then uses his or her legs to apply inwardly directed pressure to the opposite sides of the frame to grip the panels while he or she uses two hands to pass opposite ends of a stitching fiber or yarn through the holes, and to tighten the stitching fiber by pulling the ends in opposite directions. When stitching of an edge is completed, leg pressure against the frame is released, the stitched pair of panels is removed, and another pair of panels is placed within the frame opening for hand stitching.

The intensive hand labor required to hand stitch an inflatable sports ball dictates that manufacturing operations using traditional methods be conducted in countries with relatively low labor costs, i.e., countries of the Far East and Asia, such as China and Pakistan. The labor intensity of hand stitching also generally limits production to about four balls per working day for an average worker.

SUMMARY OF THE INVENTION

According to one aspect, the invention features a method for hand stitching of multi-panel sports balls. The method includes (a) moving the free ends of opposed gripping arms of a panel gripping assembly into an open position; (b) positioning a pair of panels to be stitched to form a multi-panel sports ball between the free ends, with edges of the panels and holes formed along the edges being in position for stitching; (c) allowing the free ends to move from the open position to a closed position; (d) forming a first stitch in the panels by passing a stitching fiber through a first set of aligned holes in the panels; (e) engaging opposite ends of the stitching fiber in first and second gripping members disposed at opposite sides of said gripping arms; (f) tightening the first stitch by actuating a pneumatic cylinder associated with the first and second gripping members to move the first and second gripping members relatively apart; (g) removing the opposite ends of the stitching fiber from the first and second gripping members; and (h) repeating the stitch-forming and stitch-tightening steps to form subsequent stitches, until stitching along the edge is completed.

Preferred embodiments of this aspect of the invention may include one or more of the following additional features. The method includes the further step of replacing or repositioning the panels after stitching along the edge is completed, so that a second edge is positioned for stitching, and repeating the stitch-forming and stitch-tightening steps until stitching along the second edge is completed. The method further includes stitching along subsequent edges to form a ball cover. The method further includes the step of allowing the opposite ends of the stitching fiber and said first and second gripping members to align in common horizontal and vertical axes during the tightening step. The method further includes the step of allowing the first and second gripping members to adjust axially relative to the panels held in the gripping arms to accommodate the opposite ends of the stitching fiber having different lengths. The tightening step includes actuating the pneumatic cylinder by depressing a foot pedal to move the first and second gripping members relatively apart, e.g. under pressure preadjusted by a control valve mounted to the apparatus. The step of moving the free ends of the gripping arms into the open position includes applying pressure to the lever arm. The step of allowing the free ends to move from the open position to the closed position includes releasing the pressure from the lever arm.

In another aspect, the invention features an apparatus for hand stitching of multi-panel sports balls. The apparatus includes a panels gripping assembly including (a) a pair of opposed gripping arms having opposed free ends mounted for relative movement between a first, closed position gripping a pair of panels to be stitched and second, open position for releasing a stitched pair of panels and receiving a pair of panels to be stitched, (b) a biasing member urging the opposed free ends toward the first, closed position; and (c) a lever arm urging the free ends toward the second open position in response to pressure applied by a user; and a stitching fiber tensioning assembly including (a) a first string gripping member and a second string gripping member disposed at opposite sides of said pair of opposed gripping arms and positioned to releasably hold opposite ends of a stitching string in generally common horizontal and vertical planes during stitch tensioning; and (b) a pneumatic cylinder adapted, when actuated by the user, to urge the first and second string gripping members apart with a predetermining tensioning force during stitch tensioning, said first and second string gripping members being slidably mounted upon said frame relative to said pair of gripping arms, wherein, during tensioning of the stitching string, said first and second gripping members slide relative to said pair of gripping arms to accommodate application of uniform tensioning to opposite ends of a stitching string having different lengths.

Preferred embodiments of this aspect of the invention may include one or more of the following additional features. The first and second string gripping members are mounted for axial movement on a pair of substantially parallel posts, so that as stitching of the panels progresses, the axial positions of the gripping members adjust as tension is applied to the stitching fiber by the pneumatic cylinder. The biasing member includes a spring. At least one of the opposed gripping arms is hinged to allow rotation between the open and closed positions.

The invention thus provides an apparatus and method for hand stitching multi-panel sports balls with increased uniformity and quality of stitching and tension, and also with improved efficiency.

Other features and advantages will be apparent from the following description of a presently preferred embodiment, and from the claims.

DESCRIPTION OF THE PREFERRED EMBODIMENTS

Figure 1:
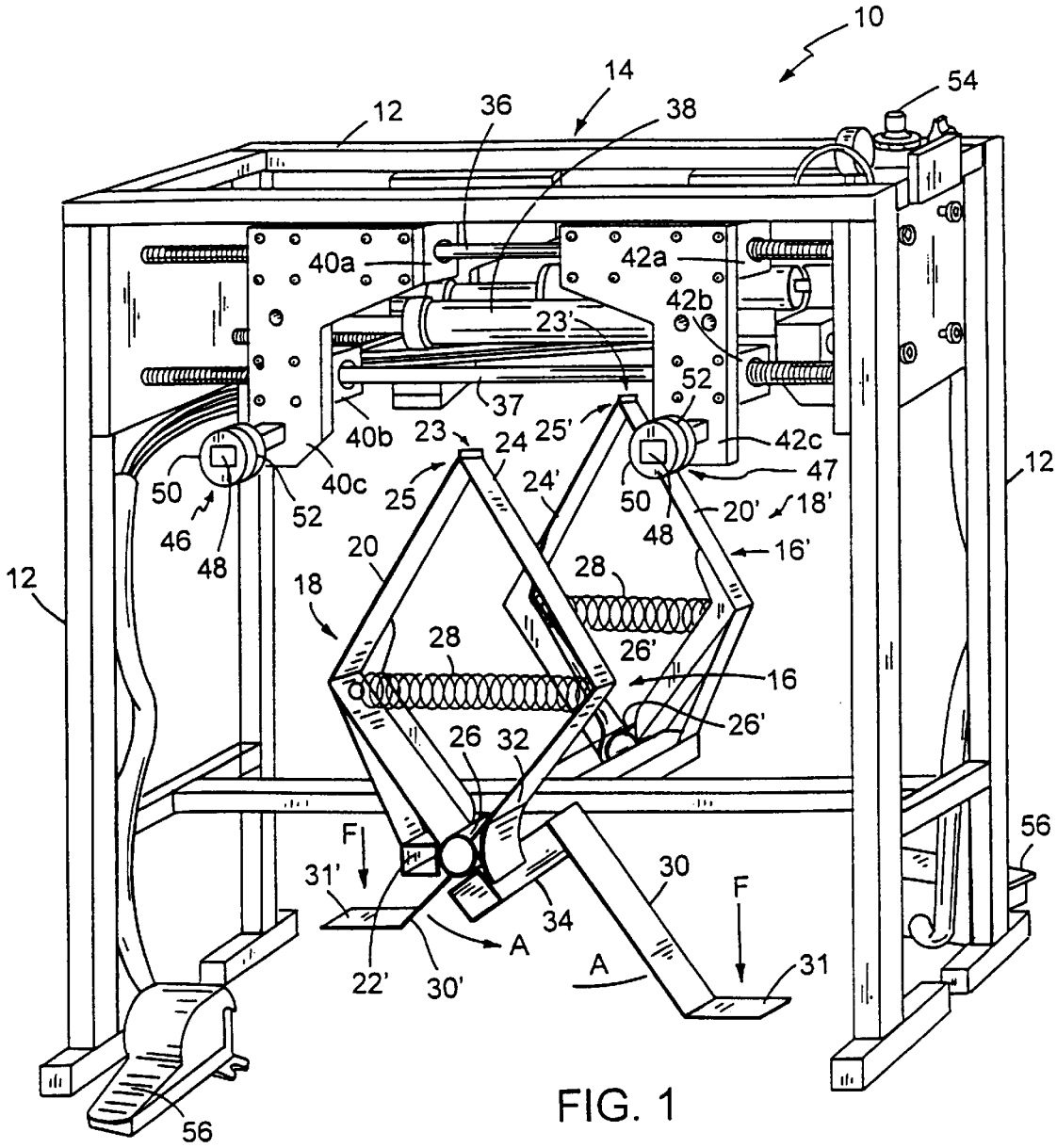
FIG. 1 is a front perspective view of a workstand apparatus of the invention for use during hand stitching of panels for inflatable sports balls showing a first work station.
Figure 2:
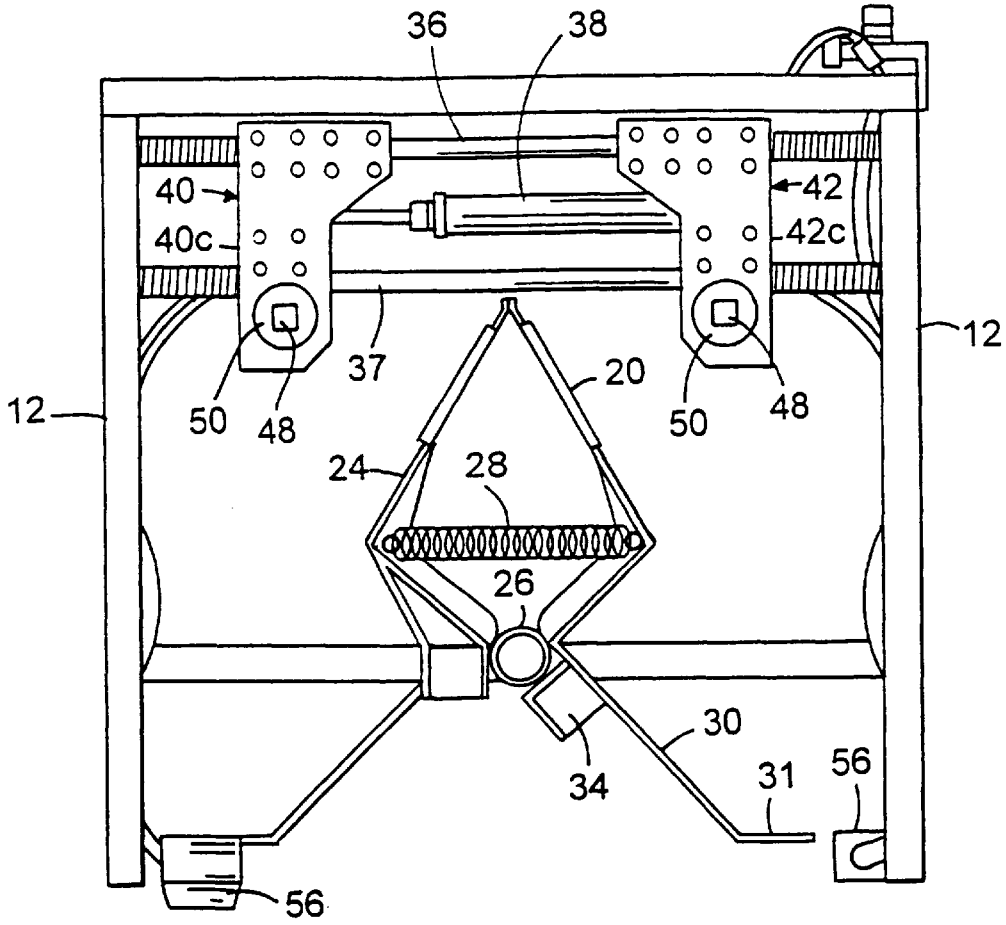
FIG. 2 is a front plan view of the workstand apparatus of FIG. 1.
Figure 2A:
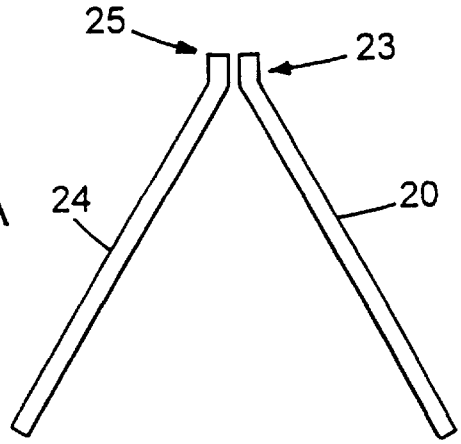
FIG. 2A is an enlarged detail view of the upper portions and free ends of the gripping arms of the workstand apparatus of FIG. 2.
Figure 3:
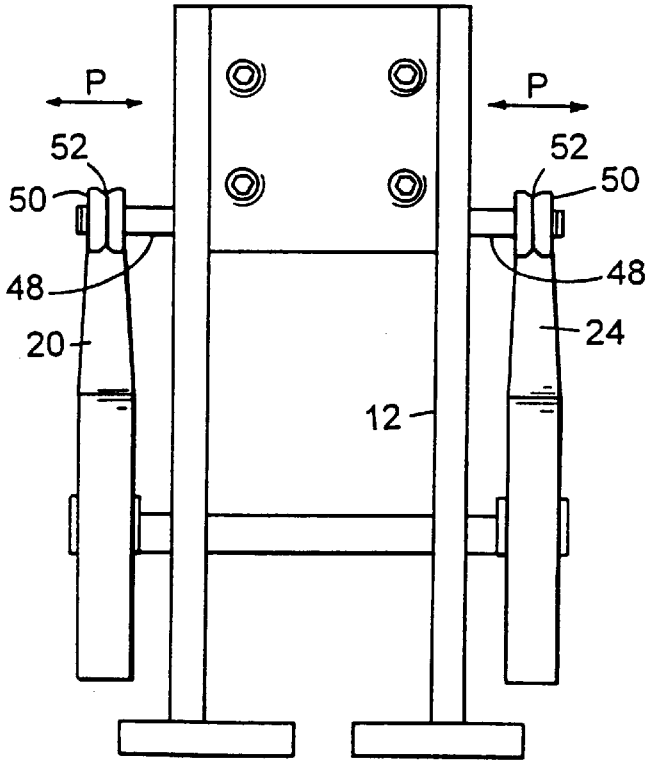
FIG. 3 is an end view of the workstand apparatus of FIG. 1.
Figure 4:
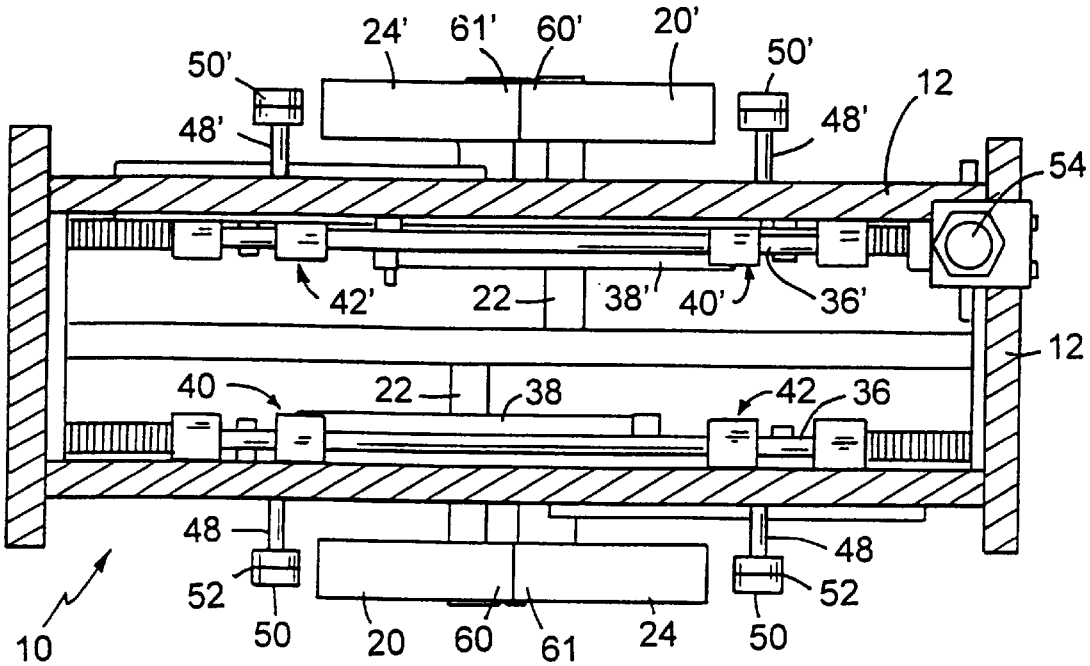
FIG. 4 is a top plan view of the workstand apparatus of FIG. 1.

Referring to FIG. 1, a workstand apparatus 10 of the invention for use in hand stitching panels during manufacture of inflatable sports balls has a frame 12 defining a first work station 18 and an opposite, second work station 18'. The first and second work stations are identical; in other embodiments, a workstand apparatus of the invention may include a single work station, or may include multiple, i.e. more than two, work stations mounted to a single frame. For clarity, we will describe only the first work station.

The first work station 18 defined by frame 12 of workstand apparatus 10 includes a tensioning assembly 14 and a gripping frame 16. The gripping frame consists of a first arm 20 fixedly mounted to a frame arm 22 extending from frame 12, and an opposed, second arm 24 pivotally mounted to the frame arm 22 by hinge 26. The arms 20, 24 have opposed, upper free ends 23, 25, respectively, the upper free end 25 of the moveable arm 24 being biased toward gripping engagement with the upper free end 23 of the fixed arm 20 by a spring 28 attached between the arms 20, 24.

The free end 25 of arm 24 is moved out of gripping engagement with the free end 23 of arm 20 by application of downward force (arrow F, FIG. 1), applied, e.g. by the worker's leg, to a lever pedal 31 at the end of a lever arm 30 attached at the lower end 32 of the arm 24 by way of a horizontal bar 34. Application of downward force, F, to the lever pedal 31 causes lever arm 30 to rotate (arrow, A), which in turn causes the movable arm 24 to pivot about hinge 26, with the free end 25 moving away from the free end 23 of fixed arm 20.

Tensioning assembly 14 consists of a pair of generally parallel upper and lower slide bars 36, 37, respectively, upon which are mounted first and second slide assemblies 40, 42, respectively, with a pneumatic cylinder 38 disposed therebetween. Each slide assembly 40, 42 includes upper and lower slide elements 40*a*, 40*b* and 42*a*, 42*b*, respectively, joined by a slide plate 40*c*, 42*c*. Each of the upper and lower slide elements 40*a*, 40*b* and 42*a*, 42*b*, respectively, defines a bore for receiving an upper or lower slide bar 36, 37, respectively, therethrough in sliding engagement.

Figure 6:
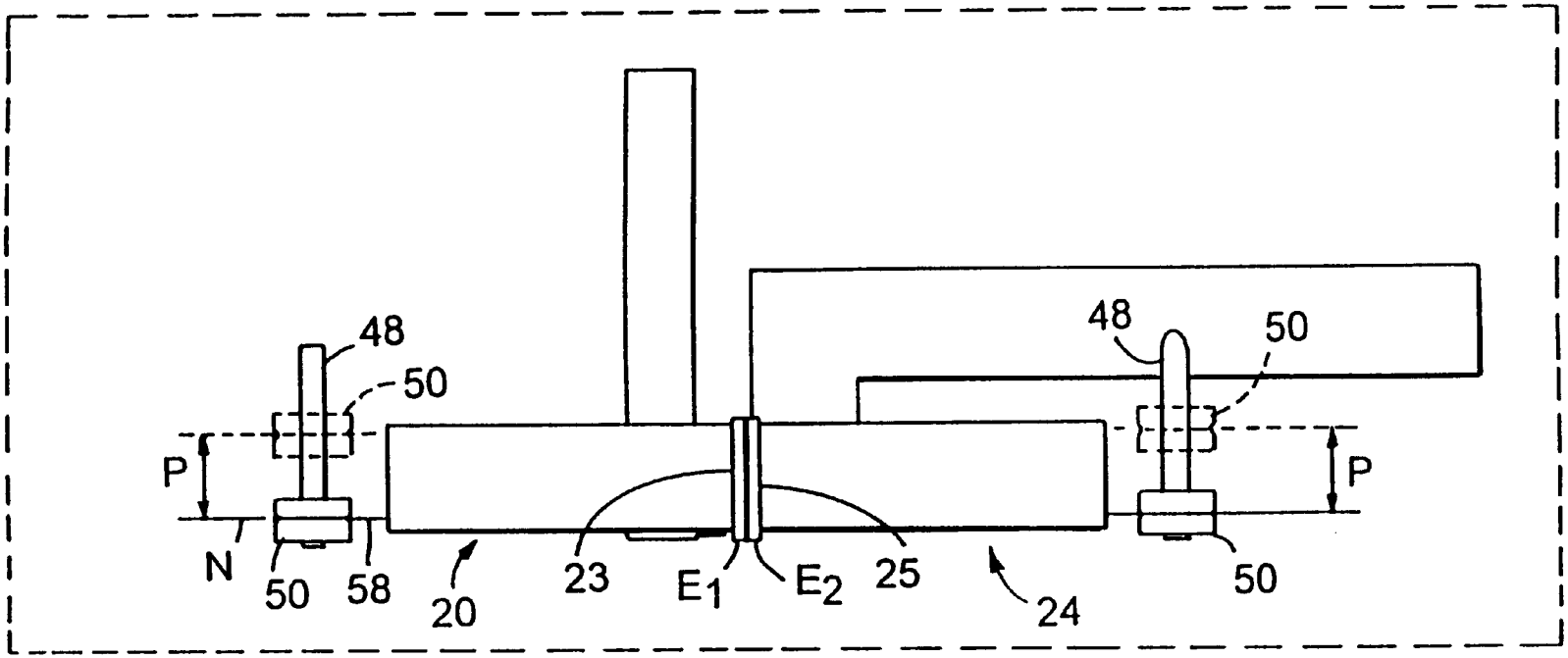
FIG. 6 is a somewhat diagrammatic top plan view of the stitching fiber gripping assembly of the workstand apparatus of FIG. 1.

Mounted to slide plates 40*c*, 42*c* are string tensioning assemblies 46, 47, respectively, each consisting of a post 48 with a cylindrical gripping member 50 mounted thereupon for sliding movement (arrow, P, FIG. 6). The gripping member 50 preferably has the form of a cylinder with a tapered slit 52 sized to grip a stitching fiber when engaged therewithin, without damage to the stitching fiber. For example, the tapered slit may be sized to accommodate, i.e. grip, stitching fibers having different diameters.

The pneumatic cylinder 38 is connected to a source of pneumatic pressure (not shown), pressure to the cylinder being controlled by adjustable control valve 54. The pneumatic cylinder is actuated by foot pedal 56, as will be described more fully below.

The operation of the work station apparatus will now be described with reference to FIGS. 1 et seq.

The worker is seated at the first work station 18 of workstand apparatus 10, in front of the gripping frame 16, with his or her legs generally straddling the lever arm 30. The worker, with his or her leg, applies pressure (arrow, F) to the lever pedal 31 of lever arm 30 to disengage the free end 25 of gripping arm 24 from the opposed free end 23 of gripping arm 20. The lever pedal 31 is adjustably positioned to fit the natural range of leg movement for each worker, to allow movement of the leg to actuate the lever arm 30 without extra movement, so that the worker will not tire easily.

Figure 5:
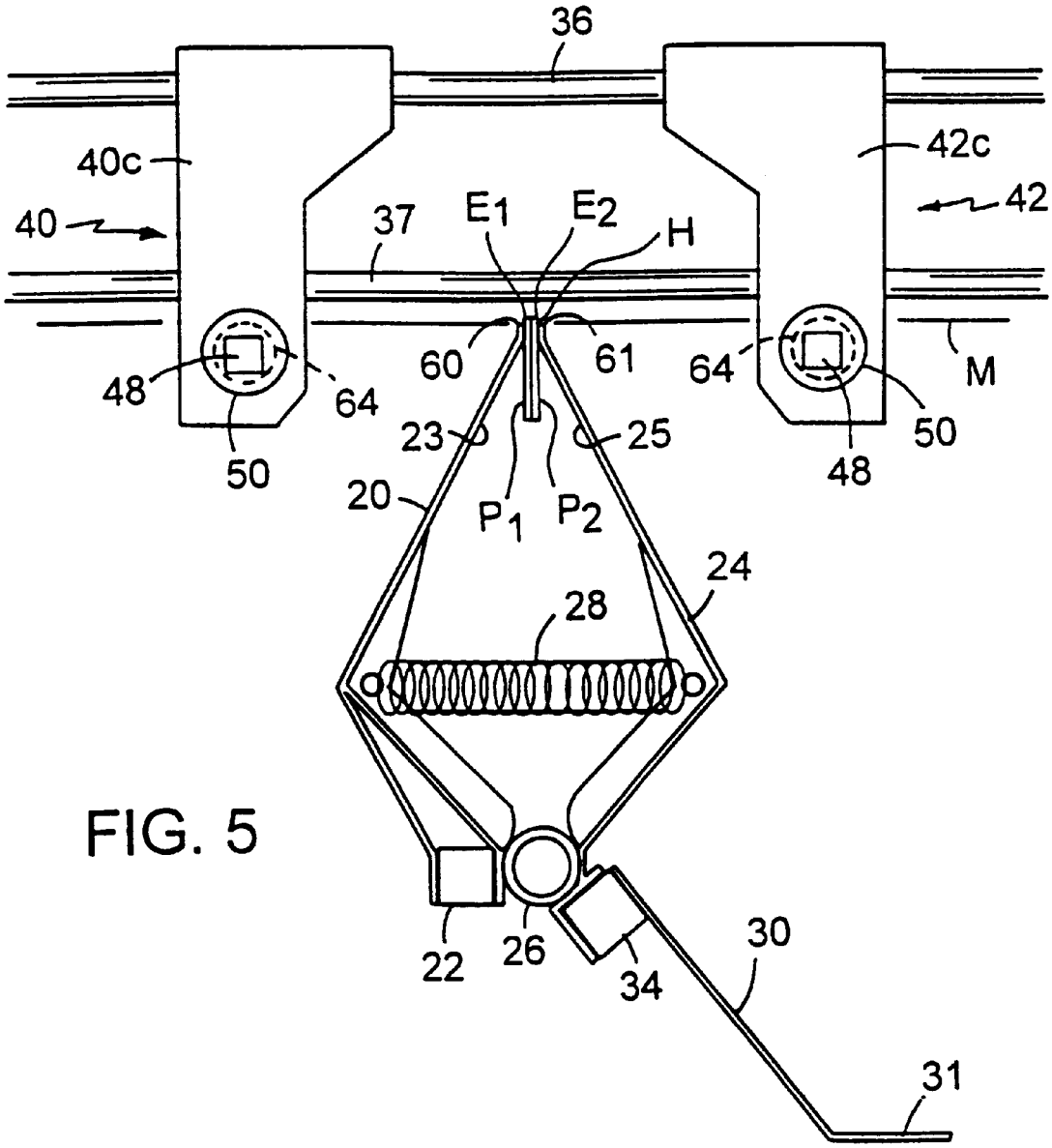
FIG. 5 is a somewhat diagrammatic front view of the stitching fiber gripping assemblies of the workstand apparatus of FIG. 1.

A pair of pre-cut panels, $P_1$, $P_2$ to be stitched together for forming an inflatable sports ball are arranged with the opposed edges $E_1$, $E_2$ of the respective panels, $P_1$, P2, respectively, and the respective rows of adjacent punched or pierced holes along which the seam is to be stitched, in alignment. As shown in FIG. 5, the pair of panels $P_1$, $P_2$ is placed between the free ends 23, 25, with the panel edges $E_1$, $E_2$ generally parallel to the ends 60, 61 of the free ends 23, 25, and the holes, H, generally in a plane, M, with the base 64 of the slit 52 in each cylindrical gripping member 50, as will be described more fully below.

The worker releases pressure from lever arm 30, allowing the spring-biased free end 25 of arm 24 to move to grip the panels $P_1$, $P_2$ securely against the free end 23 of fixed arm 20, without the need for the worker to continuously apply pressure to the frame.

A stitching fiber 58 is passed through a first set of aligned holes in the panels $P_1$, $P_2$, and then a first stitch is taken by passing the opposite ends of the stitching fiber through a second set of aligned holes to define a first stitch. The opposite end portions of the stitching fiber 58 are then engaged about the gripping members 50 in the slits 52, and the pneumatic cylinder 38 is actuated by pressing foot pedal 56 to urge apart the slide assemblies 40, 42 with a predetermined pressure (set by the cylinder pressure control valve 54), tensioning the stitching fiber and tightening the stitches. The pneumatic cylinder 38 is then deactivated, and the opposite ends of the stitching fiber 58 are disengaged from the slits 52, and second, and subsequent, stitches are taken with the opposite ends of the stitching fiber in the manner described above. After each stitch, the new stitch is tightened as described above. This process is repeated until stitching along the pair of edges $E_1$, $E_2$ is completed.

The free end 25 of the gripping arm 24 is then disengaged from the free end 23 of the gripping arm 20 (by applying pressure to the lever pedal 31 of lever arm 30), the stitched panels are removed or repositioned, and the process is repeated as above with the same or another pair of panels.

As described above, a pair of panels $P_1$, $P_2$ to be stitched is positioned and engaged in the frame with the stitch holes, H, generally in a plane, M, with the base 64 of the stitching fiber gripping regions (slits 52) of the gripping members 50 (FIG. 5). Referring also to FIG. 6, the gripping members 50 are mounted to slide (arrow, S) on posts 48, so that as stitching of the panels progresses along the edges $E_1$, $E_2$, the axial positions of the gripping members 50 along the posts 48 adjust automatically as tension is applied to the opposite ends of the stitching fiber by the pneumatic cylinder 38. This axial adjustment maintains the gripping regions of the respective gripping members continuously in a common plane with the hole through which each stitch being tightened is taken, thereby to maintain relatively more uniform tension from stitch to stitch, e.g. relative to conventionally hand stitched balls.

Figure 7:
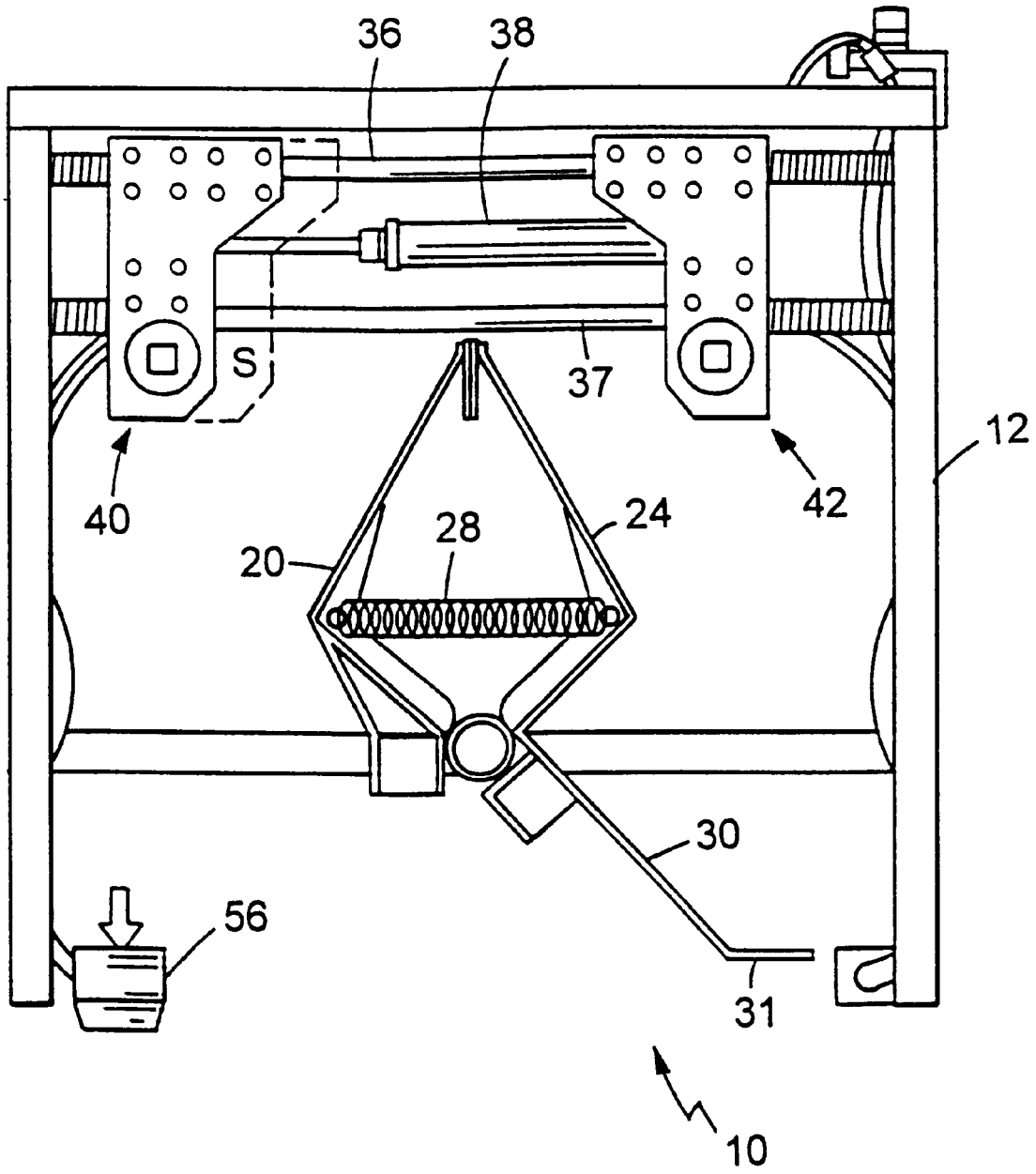
FIG. 7 is a diagrammatic front plan view of the stitching fiber tensioning assembly of the workstand apparatus of FIG. 1, with the stitching fiber tensioning assembly in a first position.
Figure 8:
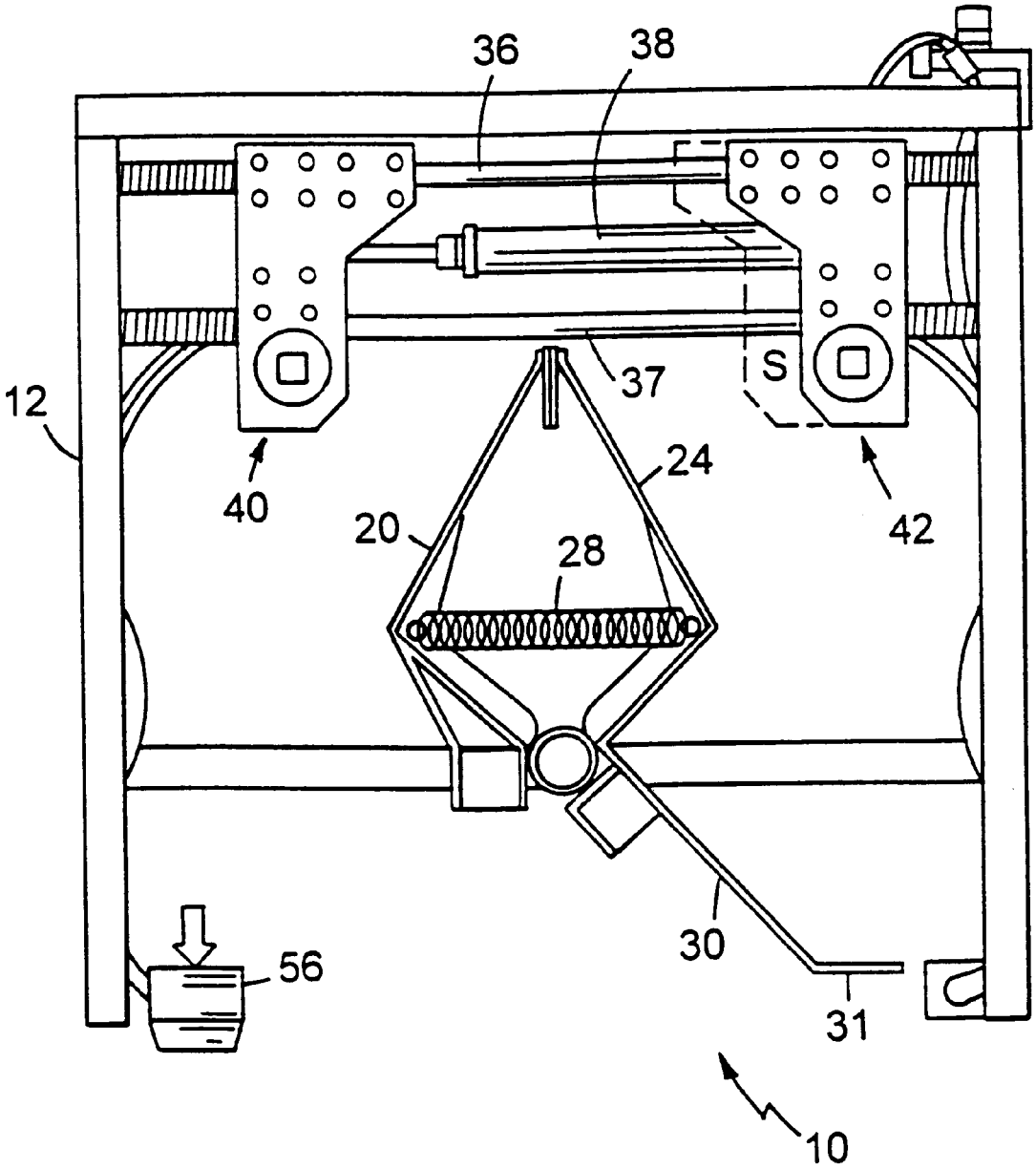
FIG. 8 is a similar diagrammatic front plan view of the stitching fiber tensioning assembly of the workstand apparatus of FIG. 1, with the stitching fiber tensioning assembly in a second position.

Referring also to FIGS. 7 and 8, the gripping members 50 are mounted on slide assemblies 40, 42 to be slidable axially (arrows S, FIG. 7) along slide bars 36, 37, relative to the plane N (FIG. 6) of the panel gripping region of the frame. This sliding arrangement allows the pneumatic cylinder 38 to apply relatively uniform tightening pressure against both ends of the stitching fibers drawn through the holes of the panel, even when the opposite ends of the fibers are of quite different lengths, e.g., as shown in FIGS. 7 and 8.

Thus, the opposite ends of the stitching fiber 58, engaged in the slits 52 of the gripping members 50 (in a manner so as to avoid damage to the stitching fiber) are drawn apart with generally uniform pressure from stitch to stitch. The tension applied to the stitch from each end of the stitching fiber is generally uniform, independent of the position of the plane of panels being stitched relative to the axis of the stitching fibers tensioned by the cylinder.

Figure 9:
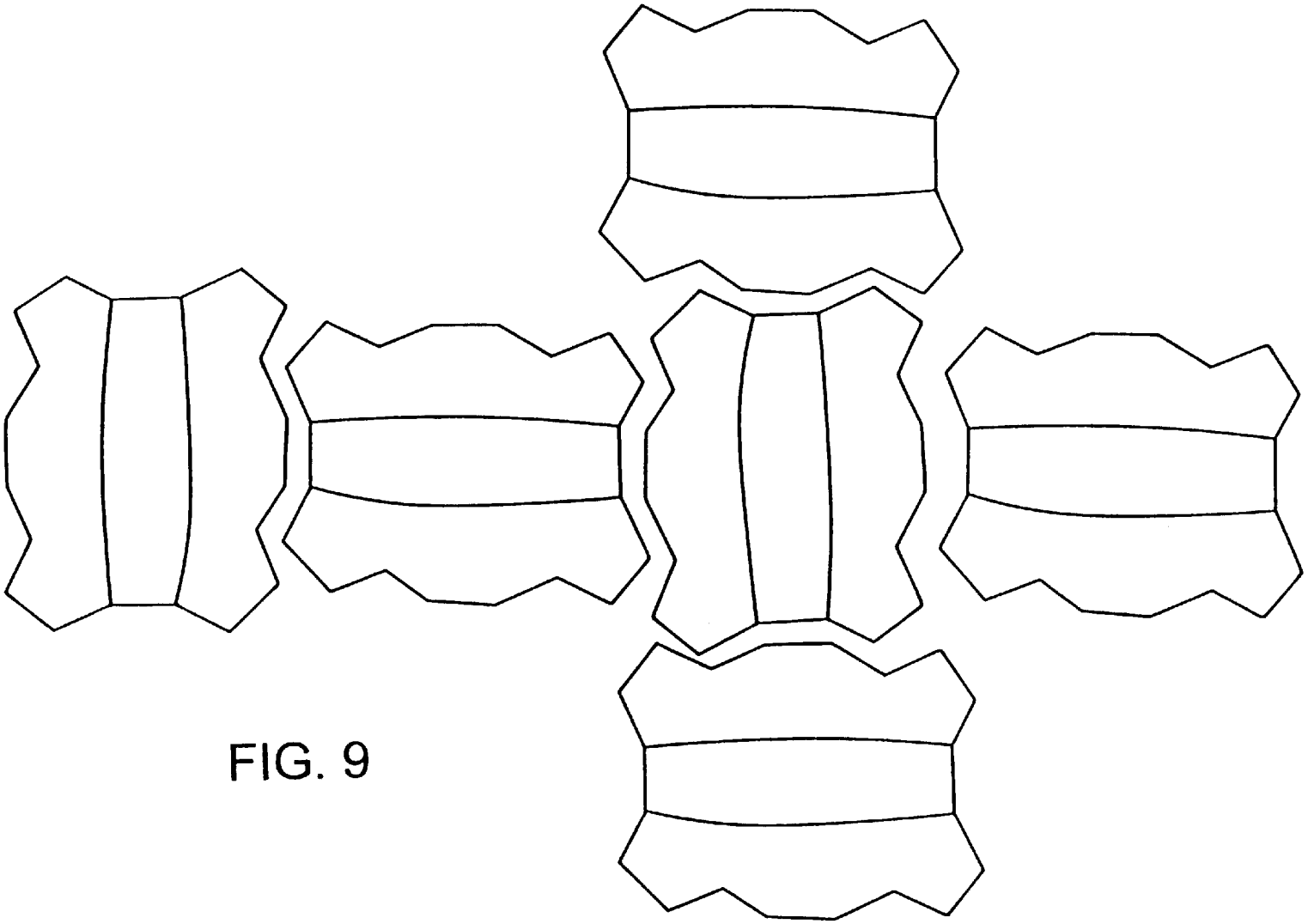
FIGS. 9 and 10 are plan views of multi-panel elements, i.e., a plurality of panels stitched together in a flat pattern, prior to closure to form a ball.
Figure 10:
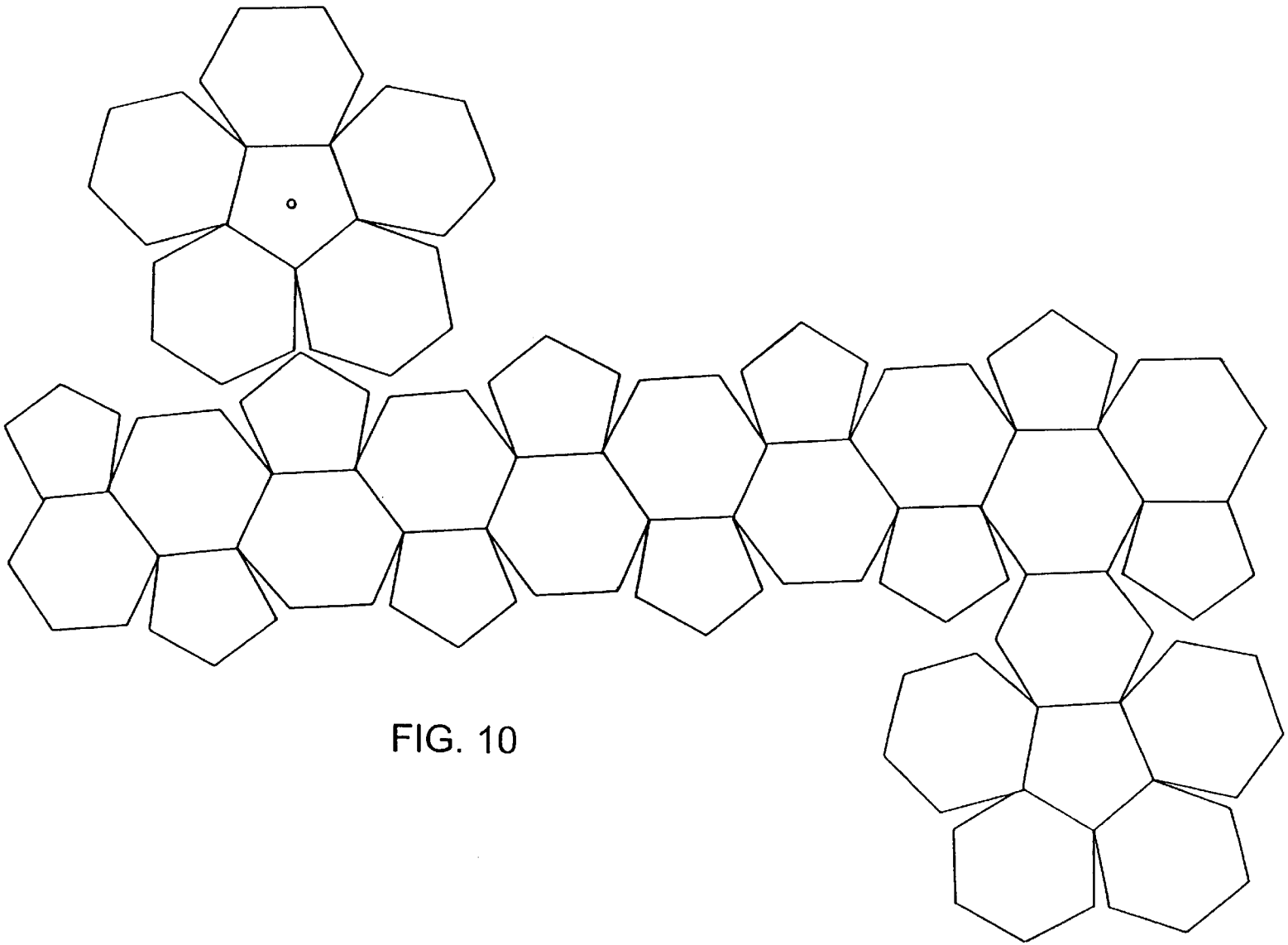

In a typical stitching operation, panels are pre-assembled in three groups of multiple panels, then the pre-assembled groups of multiple panels are assembled (with the edges to the outside) to form a ball cover, with one seam left unstitched. Typical stitching patterns for pre-assembled panels are shown in FIGS. 9 and 10. The cover is then inverted through the open seam and the inflatable bladder is placed within the cover, and the final seam is stitched by hand. The panels may be formed, e.g., of leather or other suitable material, including laminates of synthetic polymeric material and/or fabric.

It has been found that use of the method and apparatus of the invention allows increased efficiency, e.g. an average worker can complete about six balls per day, compared to four balls per day in a typical hand stitch operation. Also, use of the tightening assembly provides more uniform stitching tension and quality in the finished ball, e.g. as compared to conventionally hand stitched balls.

Other embodiments are within the following claims. For example, in other embodiments, a work station apparatus of the invention may define other numbers of work stations, e.g. one or more than two, in any suitable arrangement.

What is claimed is:

1. A method for hand stitching a multi-panel sports ball, comprising the steps of:

applying pressure to a lever pedal to move the free ends of opposed gripping arms of a panel gripping assembly into an open position;

positioning a pair of panels to be stitched to form a multi-panel sports ball between the free ends, with edges of the panels and holes formed along the edges being in position for stitching;

moving the free ends from the open position to a closed position;

inserting a stitching fiber through a first set of aligned holes in a panel;

forming a first stitch in the panels by passing a first end of the stitching fiber and an opposite, second end of the stitching fiber, in opposite directions, through another set of aligned holes in the panels;

engaging the first and second ends of the stitching fiber in first and second gripping members disposed at opposite sides of said gripping arms;

tightening the stitch by actuating a pneumatic cylinder associated with the first and second gripping members to move the first and second gripping members relatively apart;

removing the first and second ends of the stitching fiber from the first and second gripping members; and repeating the stitch-forming and stitch-tightening steps to form subsequent stitches, until stitching along the edge is completed.

2. The method of claim 1, comprising the further step of replacing or repositioning the panels after stitching along the edge is completed, so that a second edge is positioned for stitching, and repeating the stitch-forming and stitch-tightening steps until stitching along the second edge is completed.

3. The method of claim 2 further comprising stitching along subsequent edges to form a ball cover.

4. The method of claim 1, comprising the further step of aligning the opposite ends of the stitching fiber and said first and second gripping members in common horizontal and vertical axes during the tightening step.

5. The method of claim 1 or 4, comprising the further step of adjusting the first and second gripping members axially relative to the panels held in the gripping arms to accommodate the opposite ends of the stitching fiber extending to different distances from the panels during tightening.

6. The method of claim 1 wherein said tightening step includes actuating the pneumatic cylinder by depressing a foot pedal to move the first and second gripping members relatively apart.

7. The method of claim 1 wherein said step of moving said free ends of said gripping arms into said open position includes applying pressure to the lever arm.

8. The method of claim 7 wherein said step of moving said free ends from said open position to said closed position includes releasing said pressure from said lever arm.

9. A workstand apparatus for use during hand stitching of panels during manufacture of multi-panel inflatable sports balls, said workstand apparatus comprising:

a panels gripping assembly comprising a pair of opposed gripping arms having opposed free ends mounted for relative movement between a first, closed position gripping a pair of panels to be stitched and a second, open position for releasing a stitched pair of panels and receiving a pair of panels to be stitched, a biasing member urging the opposed free ends toward the first, closed position; and a lever arm urging the free ends toward the second open position in response to pressure applied by a user; and a stitching fiber tensioning assembly comprising a first string gripping member and a second string gripping member disposed at opposite sides of said pair of opposed gripping arms and positioned to releasably hold opposite ends of a stitching string in generally common horizontal and vertical planes during stitch tensioning; and a pneumatic cylinder adapted, when actuated by the user, to urge the first and second string gripping members apart with a predetermining tensioning force during stitch tensioning, said first and second string gripping members being slidably mounted upon said frame relative to said pair of gripping arms, wherein, during tensioning of the stitching string, said first and second gripping members slide relative to said pair of gripping arms to accommodate application of uniform tensioning to opposite ends of a stitching string extending to different distances from the panels during stitch tensioning.

10. The workstand apparatus of claim 9 wherein said first and second string gripping members are mounted for axial movement on a pair of substantially parallel posts, so that as stitching of the panels progresses, the axial positions of the gripping members adjust as tension is applied to the stitching fiber by the pneumatic cylinder.

11. The workstand apparatus of claim 9 wherein said biasing member comprises a spring.

12. The workstand apparatus of claim 9 wherein at least one of said opposed gripping arms is hinged to allow rotation between said open and closed positions.

* * * * *